US007828937B2

(12) United States Patent
Strauch

(10) Patent No.: US 7,828,937 B2
(45) Date of Patent: Nov. 9, 2010

(54) SCRAPER BLADE HOLDING DEVICE WITH SCRAPER BLADE CARRIER

(75) Inventor: Helmut Strauch, Ebelsbach-Rubendorf (DE)

(73) Assignee: Joh. Clouth GmbH & Co. KG, Hückeswagen (DE)

( * ) Notice: Subject to any disclaimer, the term of this patent is extended or adjusted under 35 U.S.C. 154(b) by 272 days.

(21) Appl. No.: 12/225,003

(22) PCT Filed: Mar. 20, 2007

(86) PCT No.: PCT/EP2007/052617

§ 371 (c)(1),
(2), (4) Date: Sep. 11, 2008

(87) PCT Pub. No.: WO2007/110353

PCT Pub. Date: Oct. 4, 2007

(65) Prior Publication Data

US 2009/0065165 A1 Mar. 12, 2009

(30) Foreign Application Priority Data

Mar. 25, 2006 (DE) ..... 10 2006 013 892

(51) Int. Cl.
*D21G 3/00* (2006.01)

(52) U.S. Cl. ..... 162/272; 162/280; 15/256.51

(58) Field of Classification Search ..... 162/272, 162/280, 281; 15/236.01, 256.51; 30/329
See application file for complete search history.

(56) References Cited

U.S. PATENT DOCUMENTS

| | | | | |
|---|---|---|---|---|
| 4,367,120 | A * | 1/1983 | Hendrikz | 162/281 |
| 4,665,859 | A * | 5/1987 | Dunlap et al. | 118/126 |
| 5,279,710 | A * | 1/1994 | Aikawa | 162/281 |
| 5,408,720 | A * | 4/1995 | Miles | 15/256.51 |
| 6,202,252 | B1 * | 3/2001 | Harrisson | 15/256.51 |
| 6,361,656 | B1 * | 3/2002 | Rata | 162/281 |
| 6,447,646 | B1 * | 9/2002 | Hassinen et al. | 162/281 |
| 7,665,178 | B2 * | 2/2010 | Strauch | 15/256.51 |
| 2006/0054293 | A1 * | 3/2006 | Strauch | 162/280 |

FOREIGN PATENT DOCUMENTS

| | | |
|---|---|---|
| DE | 557 556 | 8/1932 |
| JP | 09-041287 | 2/1997 |
| WO | WO 2004/012143 | 2/2004 |

OTHER PUBLICATIONS

International Search Report, Jun. 2007.

* cited by examiner

*Primary Examiner*—Mark Halpern
(74) *Attorney, Agent, or Firm*—Collard & Roe, P.C.

(57) ABSTRACT

The invention relates to a scraper blade holding device comprising a mounting unit into which a scraper blade is normally inserted. According to the present invention a scraper blade carrier, which has in its region projecting out of the mounting unit fastening means for a scraper blade, is inserted into the mounting unit. This has the advantages that scraper blades with reduced dimensions can be used.

10 Claims, 2 Drawing Sheets

SCRAPER BLADE HOLDING DEVICE WITH SCRAPER BLADE CARRIER

CROSS REFERENCE TO RELATED APPLICATIONS

Figure 1:
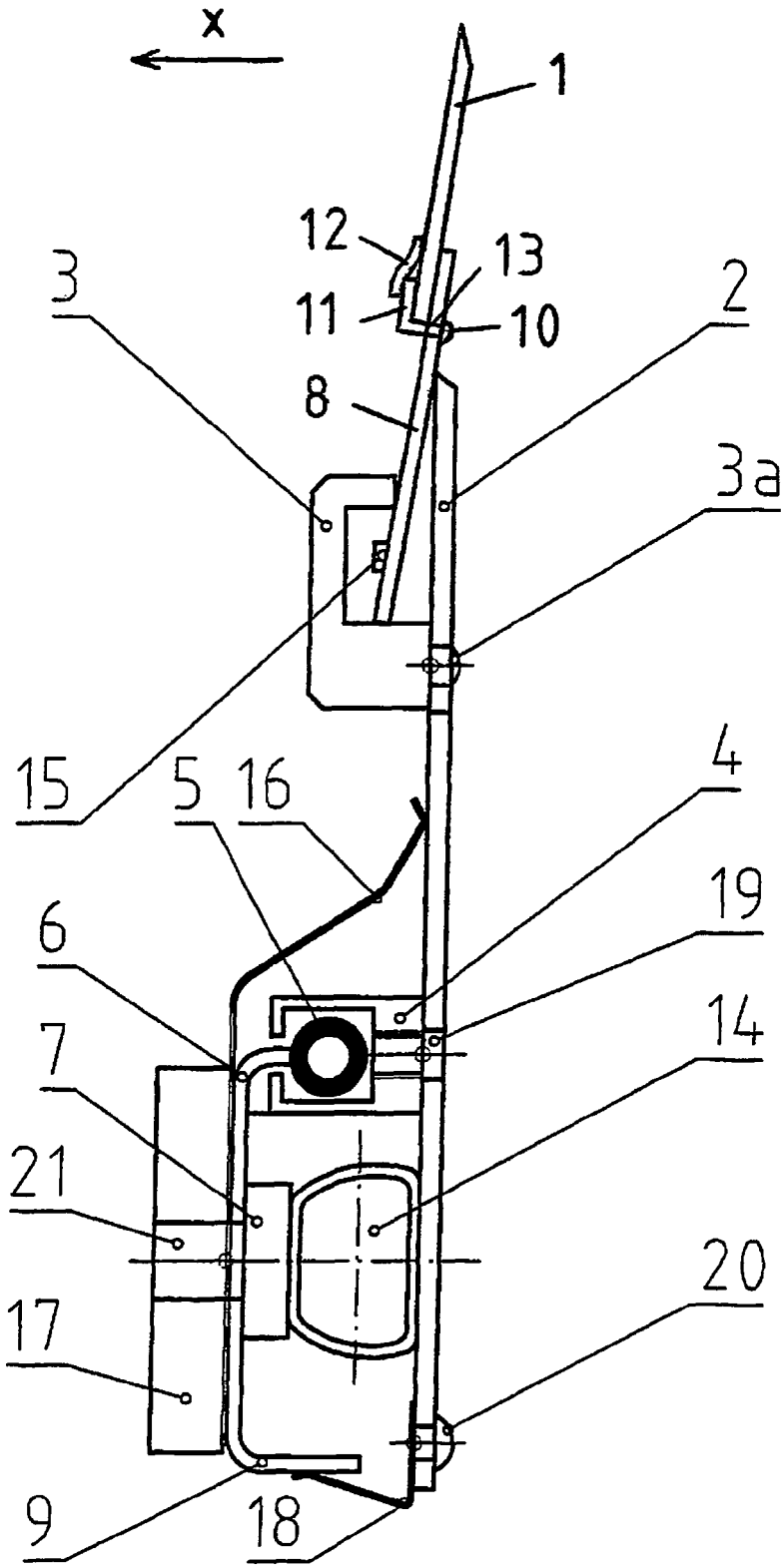

This application is the National Stage of PCT/EP2007/052617 filed on Mar. 20, 2007, which claims priority under 35 U.S.C. §119 of German Application No. 10 2006 013 892.9 filed on Mar. 25, 2006. The international application under PCT article 21(2) was not published in English.

The invention relates to a scraper blade holding device having a mounting unit provided for mounting a scraper blade.

A scraper blade holding device of that kind can be used in, for example, a paper factory in the field of paper manufacture or in the steel industry. It usually serves for mounting a scraper blade for the purpose of uniform contact thereof with a rotating roll or roller in order to clean its surface during operation. A roll of that kind can have a diameter of, for example, 1 meter to 6 meters and a length of up to 10 meters. The scraper blade provided for cleaning such a roll must bear against the roll over the entire length thereof as uniformly as possible at a predetermined angle. In order to achieve this the scraper blade is usually laid against the roll with a lineal pressure of between 100 and 400 Newtons per meter. A conventional scraper blade has, for example, up to 10 meters length, 7.5 centimeters width and 1.5 millimeters thickness. A conventional scraper blade consists of, for example, carbon-fibre material.

In operation of the scraper blade the region of the scraper blade bearing against the roll is progressively worn down so that the remaining width of the scraper blade is increasingly reduced. If the scraper blade has reached a width of, for example, 6.5 centimeters, then it is regarded as worn out and is replaced by a new scraper blade.

A scraper device with a transportable scraper blade is known from JP 09041287 A. In this known device the scraper blade consists of a changeable blade, which in operation is pressed directly against the surface of a roll, and a retaining blade, which forms a carrier for the changeable blade. The changeable blade is an endless blade which is wound up in a roll and which in operation is placed against the surface of the rotating roll, the other end of the blade being wound up on a receiving spool. A respective part region of the endless blade is then in contact with the roll surface. If this part region is worn out, then the endless blade can be further unwound so that a new part region of the endless blade can be contacted with the roll surface.

The object of the invention consists in showing a way how the costs of cleaning the surface of the retaining roll can be reduced.

This object is fulfilled by a scraper blade device with the features indicated in claim 1. Advantageous refinements and developments of the invention are evident from the dependent claims.

The advantages of the invention consist particularly in that by virtue of the use of an additional scraper blade carrier, scraper blades with smaller width can be used. Since a material which is substantially cheaper than the material from which a scraper blade consists is used as scraper blade carrier and since scraper blades with smaller width can be used, the costs of cleaning the surface of a rotating roll are significantly reduced by comparison with the state of the art.

The scraper blade carrier according to the invention is preferably constructed in one of its end regions like a conventional scraper blade and is inserted by this region into the mounting unit of the scraper blade holding device. Fastening means for a scraper blade are provided in the region of the scraper blade carrier projecting out of the mounting unit. A scraper blade, which by comparison with the state of the art can have a substantially smaller width, for example 3 to 4 centimeters, is inserted into these fastening means. Approximately 2 to 3 centimeters of this scraper blade, for example, in turn project beyond the end of the scraper blade carrier in direction towards the roll to be processed. From this protruding region of the scraper blade, approximately 1 centimeter is worn down in operation just as in the state of the art, until the scraper blade is regarded as worn out and is replaced and subsequently discarded. However, by contrast to the state of the art far less scraper blade material has to be discarded.

The costs for cleaning the surface of a rotating roll are thereby reduced and environmental resources are conserved, since, for example, less carbon-fibre material is needed. The scraper blade carrier according to the invention, which is inserted into the mounting unit of the scraper blade holding device, can, in the case of exchange of a scraper blade, also be reused in conjunction with the new scraper blade.

The fastening means, by way of which the scraper blade is fastened to the scraper blade carrier, preferably comprise a fixing strip and a fixing spring connected with the fixing strip. This allows a simple and quick withdrawal of a worn-out scraper blade from the scraper blade holding device and simple and quick pushing of a new scraper blade into the scraper blade holding device. This withdrawal and pushing-in can, in particular, be carried out with use of a tool.

If the scraper blade carrier is provided with bores and if the fastening means are connected with the scraper blade carrier by way of screws led through the bores, the sufficiently firm fixing, which is required for the cleaning operation, of the scraper blade is ensured. On the other hand, if necessary the screws can be released and the fastening means removed from the scraper blade carrier, for example for the purpose of exchange or cleaning.

Welding of the fastening means to the scraper blade carrier has the advantage of ensuring a sufficiently firm fixing of the scraper blade with reduced expenditure of time for fitting of the fastening means to the scraper blade carrier, but does not permit subsequent removal of the fastening means from the scraper blade carrier.

If the fixing strip is an angular construction, then the scraper blade can be pushed into place between the fixing strip and the scraper blade carrier in simple manner until it rests on the fixing strip.

The individual components of the fastening means preferably consist of stainless steel, whereby long-standing use in operation is guaranteed.

Figure 2:
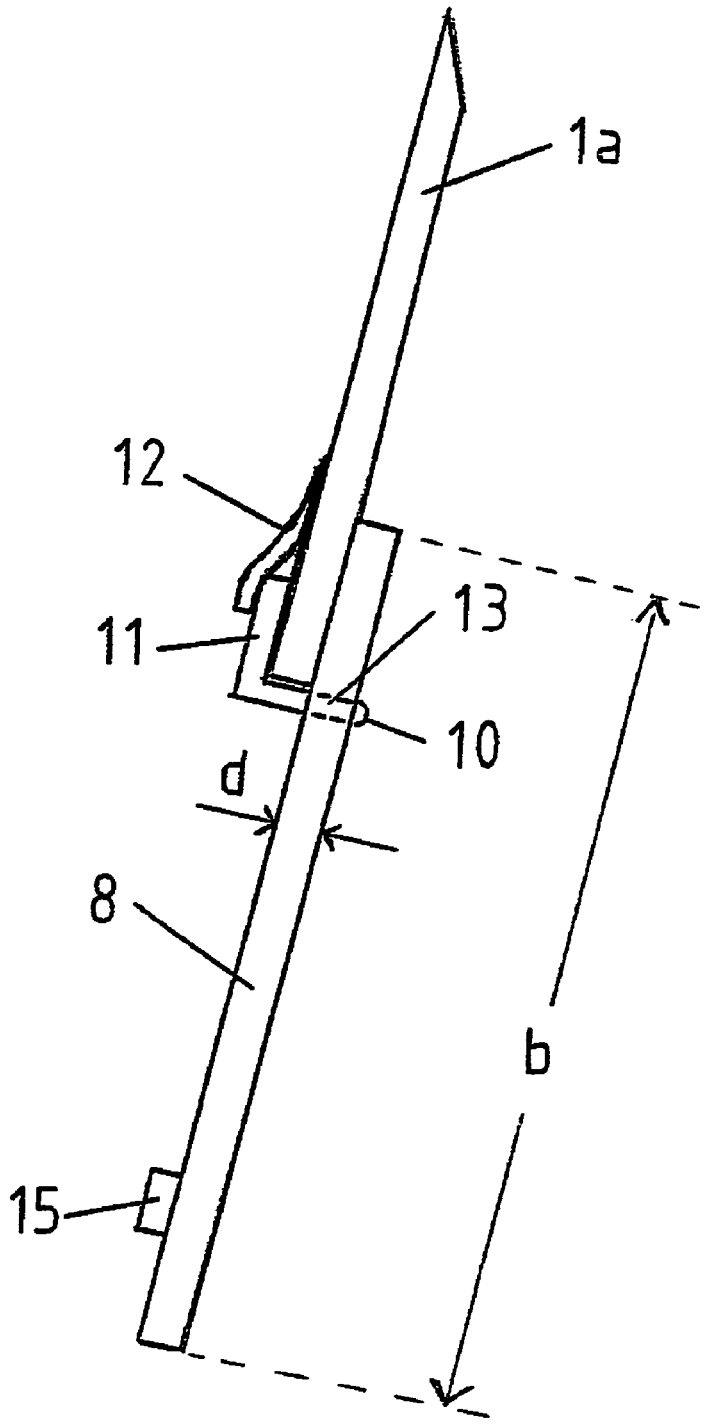

Further advantageous characteristics of the invention are evident from the explanation, by way of example, with reference to the figures, in which:

FIG. 1 shows an example of embodiment for a scraper blade holding device according to the invention and FIG. 2 shows an enlarged illustration of a part of the device illustrated in FIG. 1.

The scraper blade holding device illustrated in FIG. 1 starts from a scraper blade holding device such as is described in WO 2004/042143. It comprises a base plate 6 which is of substantially U-shaped construction and has two short and one long boundary wall. Arranged in the end region of one of the short boundary walls is a bearing tube 5 which is a component of the base plate. The bearing tube 5 is mounted within a slotted rectangular tube 4 to be rotatable relative thereto through a small angle. The rectangular tube 4 can be constructed to be segment-shaped in a direction perpendicular to the plane of the drawing so as to impair the resilience of the cover plate 2 as little as possible.

The rectangular tube is fixedly connected with the cover plate 2, preferably by means of a plurality of screw connections which are arranged one behind the other perpendicularly to the plane of the drawing, but which are not illustrated in the drawing. The cover plate 2 preferably consists of carbon-fibre material and can comprise several carbon-fibre layers. The cover plate is thereby flexible and can readily adapt to the surface of the respective roll to be cleaned.

Finger devices 3, which are similarly arranged one behind the other perpendicularly to the plane of the drawing, are fastened to the cover plate 2 in the front end region thereof by means of screw connections 3*a*. By contrast of the state of the art, a scraper blade carrier 8 is inserted between the cover plate 2 and the finger devices 3, which form a mounting unit, into which a scraper blade is usually inserted. This introduction of the scraper blade carrier is preferably carried out by pushing-in in axial direction, i.e. in a direction perpendicular to the plane of the drawing. The rear region of the scraper blade carrier is constructed just as the rear region of a conventional scraper blade so that no constructional changes of the mounting unit are necessary in order to receive the scraper blade carrier according to the invention instead of a conventional scraper blade. Since the rear region of the scraper blade carrier 8 is provided with a rivet or spring 15, the scraper blade carrier 8 cannot, in operation of the device, be withdrawn in the direction of the roll to be cleaned.

In its region projecting out of the mounting unit 2, 3 the scraper blade carrier 8 is provided with fastening means 10, 11, 12 for a scraper blade 1. A fixing strip 11 of angular construction, a fixing spring 12 connected with the fixing strip, and screws 10 belong to these fastening means. These screws are led through bores 13 of the scraper blade carrier 8 and screwed into an internal thread of the fixing strip 11 of angular construction so as to firmly connect this fixing strip 11 with the scraper blade carrier 8. The fixing spring 12 either forms an integral component together with the fixing strip 11 or is welded to the fixing strip. The fixing spring is provided for the purpose of pressing a scraper blade 1, which is pushed in between the front end region of the scraper blade carrier 8 and the fixing unit 11, against the scraper blade carrier 8 so that the scraper blade 1 in cleaning operation of the roll has the requisite fixed positioning at a predetermined angle relative to the roll to be cleaned.

Alternatively to the afore-described screw connection of the fixing strip 11 with the scraper blade carrier 8 the fixing strip can also be welded to the scraper blade carrier 8.

The scraper blade carrier 8, the fixing strip 11 and the fixing spring 12 preferably consist of stainless steel so that a long-term use of these components is guaranteed. The scraper blade carrier 8 has, for example, a length of up to 10 meters, a width of 5 centimeters and a thickness of 1.5 millimeters. It is of resilient construction so that compensation can be provided for deviations in diameter of the roll. The length of the scraper blade carrier extends in axial direction of the roll or perpendicularly to the plane of the drawing. The width b of the scraper blade carrier and the thickness d of the scraper blade carrier are marked in FIG. 2.

The scraper blade 1 fastened to the scraper blade carrier 8 by means of the fastening means 10, 11, 12 can, by comparison with the scraper blades known from the state of the art, have a substantially smaller width. The scraper blades known from the state of the art have—as was already mentioned above—a width of, for example, 7.5 centimeters. The rear side or underside of these known scraper blades is inserted directly into the mounting unit of the known scraper blade holding device. Since after wearing down, which takes place during the cleaning operation, of the scraper blade by approximately 1 centimeter, i.e. on attainment of a width of approximately 6.5 centimeters, the scraper blade is regarded as worn out and is discarded, a comparatively large part of the scraper blade has to be discarded in the case of the state of the art. This manner of procedure is costly and does not preserve environmental resources. In the case of the present invention use can be made of a scraper blade of which the width is, for example, only 3.5 centimeters. The underside of the scraper blade is not inserted into the mounting unit of the scraper blade holding device, but is fastened by way of fastening means to a scraper blade carrier which is in turn inserted into the mounting unit of the scraper blade holding device. The scraper blade carrier can also be reused after replacement of a worn-out scraper blade. The scraper blade used in the invention is worn down by approximately 1 centimeter in operation just as a known scraper blade and is then regarded as worn out and replaced by a new scraper blade. The part of the worn-out scraper blade to be replaced has, in this example of embodiment, only a remaining width of approximately 2.5 centimeters, so that by comparison with the state of the art substantially less scraper blade material has to be discarded.

In order to set the respectively desired pressing pressure of the scraper blade against the surface of the roll to be cleaned a pneumatic air hose 14 is provided in the inner region of the U-shaped base plate 6. This is provided at one end thereof with an air connection by which air can be forced into the hose and air can also be let out of the hose again. The other end of the hose 14 is closed. A plastics material inset 7 is provided between the hose 14 and the long boundary wall of the U-shaped base plate 6. This is loosely placed in position, glued on or screwed in place on the inner side of the base plate and prevents the hose 14 coming into contact with a possible hot boundary wall in operation of the device.

If the air pressure in the hose 14 is increased, then this expands. This has the effect that in the region of the hose 14 the cover plate 2 is urged away from the base plate 6. This in turn has the consequence that the scraper blade 1 is moved in the direction of the arrow x or urged in the direction x. The scraper blade is thereby placed against the roll surface to be cleaned and the desired pressing pressure set by way of a pressure regulating valve.

In addition, the scraper blade holding device illustrated in FIG. 1 has in the vicinity of the bearing tube 5 a first spring plate 16 of which one end region is fastened, for example welded, to the base plate 6. The other end region of the spring plate 16 is supported on the cover plate 2. The spring plate 16 serves, inter alia, as dust production so that no dust can penetrate into the slot of the slotted rectangular tube 4.

A second spring plate 18 is fastened in its end region, which is remote from the scraper blade 1, to the cover plate 2 by means of a screw or rivet connection 20, which plate 18 bridges over the region between the end of the boundary wall 9 of the base plate 6 and the cover plate 2 and is supported on the outer side of the boundary wall 9 of the base plate 6. This spring plate 18 also serves as dust protection or a dirt seal.

The spring plate 18 slides along the outer surface of the boundary wall 9 not only in the case of an increase, but also in the case of a reduction in the air pressure in the hose 14.

In order to be able to use the scraper blade holding device together with different scraper blade systems available on the market an adapter strip 17 is firmly connected, for example with use of screws 21, with the spring plate 16 and/or the base plate 6. This adapter strip 17 is positioned on the outer side, which is remote from the cover plate 2, of the spring plate 16 or the base plate 6.

In FIG. 1, moreover, a scraper blade holding device is shown in which the pivot plane of the scraper blade holding device is constructed and arranged in a special manner. The scraper blade holding device illustrated in FIG. 1 requires only one air hose, since production of the starting setting of the cover plate is effected by the force of the spring plate 16. The system formed by the base plate 6, the spring plate 18, a part of the cover plate 2, the rectangular tube 4 and the spring plate 16 preferably forms a substantially dust-tight unit.

REFERENCE NUMERAL LIST

1 scraper blade
2 cover plate
3 finger device
3*a* screw
4 slotted rectangular tube
5 bearing tube
6 base plate
7 plastics material insert
8 scraper blade carrier
9 boundary wall of the base plate
10 screw
11 fixing strip
12 fixing spring
13 bore
14 air hose
15 rivet or spring at the scraper blade
16 spring plate
17 adapter strip
18 spring plate
19 screw
20 screw or rivet
21 screw or stud

The invention claimed is:

1. Scraper blade holding device comprising a mounting unit (2, 3) into which a scraper blade carrier (8) is inserted, the carrier having in its region, which projects out of the mounting unit, fastening means (10, 11, 12) for a scraper blade, wherein the fastening means comprise a fixing strip (11), wherein the fastening means further comprise a fixing spring (12) connected with the fixing strip.

2. Scraper blade holding device according to claim 1, wherein the scraper blade carrier (8) is provided with bores (13) and the fixing strip is connected with the scraper blade carrier (8) by means of screws (10) led through the bores.

3. Scraper blade holding device according to claim 2, wherein the fixing strip (11) is of angular construction.

4. Scraper blade holding device according to claim 2, wherein the fixing spring (12) is welded to the fixing strip (11).

5. Scraper blade holding device according to claim 2, wherein the fixing spring forms with the fixing strip an integral component.

6. Scraper blade holding device according to claim 2, wherein the fixing strip (11) consists of stainless steel.

7. Scraper blade holding device according to claim 2, wherein the fixing spring (12) consists of stainless steel.

8. Scraper blade holding device according to claim 1, wherein the fixing strip is welded to the scraper blade carrier (8).

9. Scraper blade holding device according to claim 1, wherein the scraper blade carrier (8) consists of stainless steel.

10. Scraper blade holding device according to claim 1, wherein the scraper blade carrier (8) is of resilient construction.

* * * * *